United States Patent [19]

Frankel

[11] Patent Number: 5,050,513

[45] Date of Patent: Sep. 24, 1991

[54] STICH CONTROLLER FOR AN ELECTRIC SEWING MACHINE

[76] Inventor: Samuel R. Frankel, 211 Maple St., Shillington, Pa. 19607

[21] Appl. No.: 652,090

[22] Filed: Feb. 7, 1991

[51] Int. Cl.[5] ..... D05B 19/00; D05B 69/22

[52] U.S. Cl. ..... 112/121.11; 112/275; 112/155

[58] Field of Search ..... 112/275, 277, 121.11, 112/121.12, 2, 103, 220, 155

[56] References Cited

U.S. PATENT DOCUMENTS 4,195,582 4/1980 Novick et al. ..... 112/275 X
4,369,722 1/1983 Nishida et al. ..... 112/103
4,555,997 12/1985 Tancs ..... 112/275 X
4,593,633 6/1986 LeClaire ..... 112/275 X
4,732,095 3/1988 Saito et al. ..... 112/275 X

*Primary Examiner*—Peter Nerbun
*Attorney, Agent, or Firm*—Leonard Michael Quittner

[57] ABSTRACT

A stitch controller for installation on an electric sewing machine with a treadle and a needle positioner to make the machine semi-automatic. The controller has a CPU which directs, by means of a program in its memory, the machine through a defined number of stitches in a run of stitches and a defined number of runs of stitches. Additionally, the CPU will direct the needle position to up or down according to the program.

9 Claims, 2 Drawing Sheets

STICH CONTROLLER FOR AN ELECTRIC SEWING MACHINE

FEDERALLY-SPONSORED RIGHTS

The invention herein was made without any Federal sponsorship or contribution.

BACKGROUND OF THE INVENTION

1. The Field of the Invention

The field of the invention relates to a stitch controller for installation on an electric sewing machine with a treadle and a needle positioner. The controller has a central processing unit which defines a stitch procedure as a defined number of runs of stitches and a defined number of stitches in each run.

2. Description of the Prior Art

The prior art of interest is set forth in U.S. Pat. Nos. 4,732,095 (Mar., 1988 to Saito et al); 4,555,997 (Dec., 1985 to Tancs); 4,369,722 (Jan., 1983 to Nishida et al); and 4,195,582 (Apr., 1980 to Novick et al). Saito, Nishida and Novick all utilize a central processing unit to control sewing operations of various kinds. Tancs utilizes an array of detectors and switches. The others in some fashion utilize the presence of a needle positioner to provide information ancillary to the sewing operation. None appears to utilize the needle positioner itself as the sole means by which semi-automatic sewing operations are controlled. Both complex electric, electronic and logic circuits are required to provide the desired control of sewing operations. None is adaptable to a self-containing package containing a central processing unit (CPU) which is readily installed on any manually operated commercial sewing machine with a needle positioner and a treadle so as to make it semi-automatic.

SUMMARY OF THE INVENTION

To facilitate understanding of this specification, certain definitions are herewith set forth and used throughout. A sequence of stitches is termed a run. The run shall contain a defined number of stitches and shall terminate with the needle in an up or a down position. A sequence of a defined number of runs is termed the sewing procedure and shall terminate with the needle in the up position.

An object of the present invention is to provide installation of a stitch controller containing a central processing unit on any commercial sewing machine with a needle positioner circuit and a treadle circuit so as to make it semi-automatic.

A further object of the invention is to enable an operator of a sewing machine equipped with the stitch controller to instruct it to store for retrieval the sewing operations which the operator performs in the manual mode and thereafter to forward the instructions to a host CPU such that a multiplicity of sewing machines equipped with the CPU package can retrieve those instructions and perform the operations therein contained.

Accordingly, to accomplish the foregoing, the present invention is summarized as a stitch controller attached to a sewing machine with a needle positioner. The stitch controller is installed by means of leads to the needle positioner circuit of the machine at points normally which indicate whether the needle position is up or down and at points which set the needle positioner in such positions. Additionally, during installation the treadle circuit is disabled to the extent that toeing merely sets the machine in operation and heeling stops the machine. In this way, the treadle no longer controls the speed of the machine.

The stitch controller, when the treadle is toed, performs a first run of a defined number of stitches and stops automatically with the needle in an up or down position. By heeling and toeing again, a second run of a defined number of stitches will be performed, and so on. If a run is of substantial length, the controller will allow the stitch rate to approach its maximum and at a defined number of stitches within the run the controller will cause the stitch rate to decelerate and approach zero, stopping at the end of the run.

The controller comprises a CPU having a programmable memory, a first stitch counter register, a second run count register and a clock and means for transmitting data from the CPU's memory. A key pad attached to the CPU will enable the operator to enter information such a operator ID and job number. A display on the CPU will indicate stitch count and other information. The CPU shall have means for measuring operating time and a variety of data useful for accounting and maintenance which is transmittable to the host CPU. The CPU will be able to retrieve from the host programs for defined sewing procedures and transmit to the CPU programs for new stitch procedures.

Other objects, advantages and features of the present invention will be apparent to those skilled in the ar from the following description taken in conjunction with the accompanying drawings.

DESCRIPTION OF THE DRAWINGS

The present invention may be better understood by reference to the drawings wherein 3 figures are shown on 2 sheets. The numbers shown on the drawings for the various parts of the invention are consistent throughout so that a number indicating a part in one drawing will indicate the same part in another drawing.

DESCRIPTION OF THE PREFERRED EMBODIMENT

Figure 1:
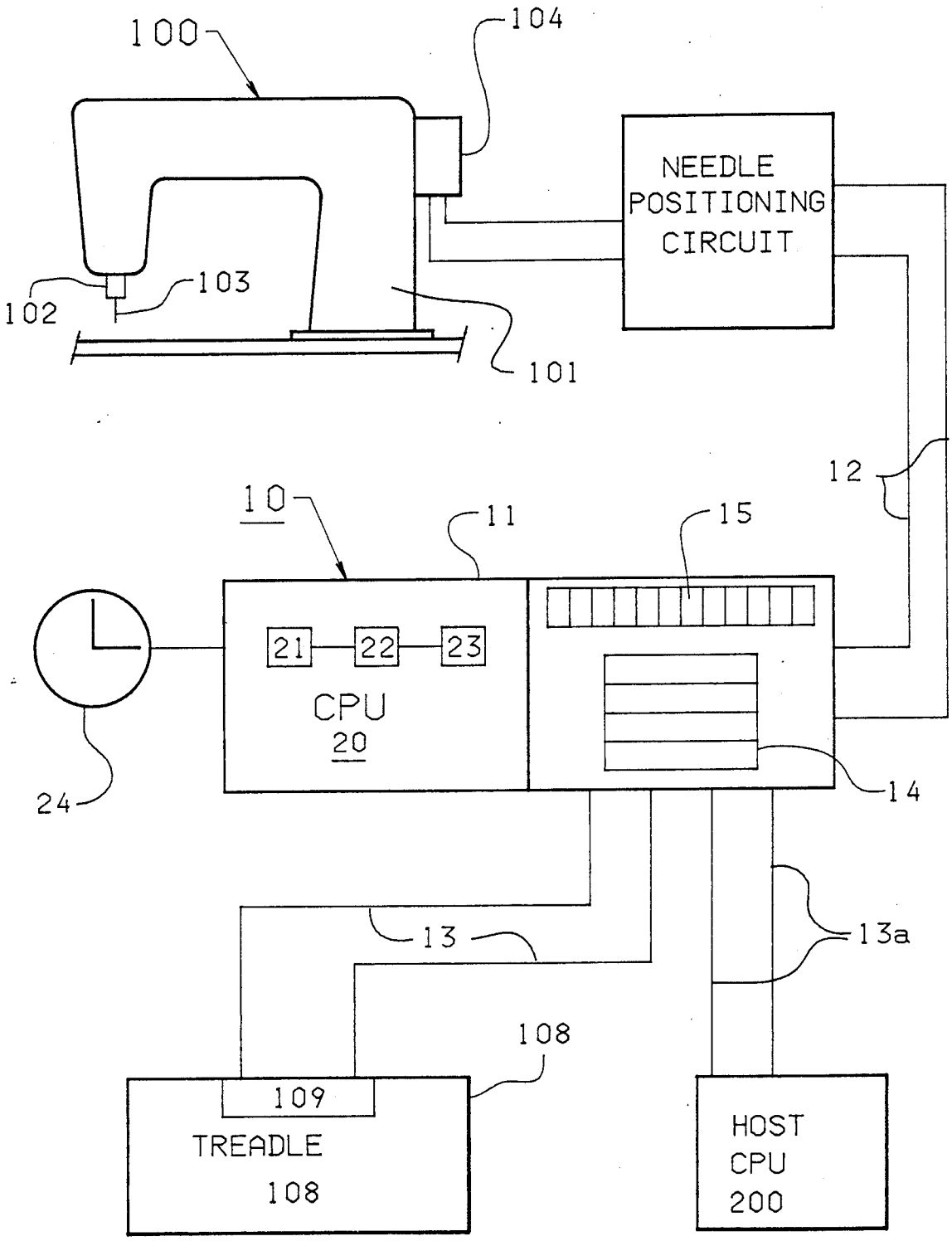
FIG. 1 shows a programming circuit diagram for a sewing machine stitch controller.
Figure 2:
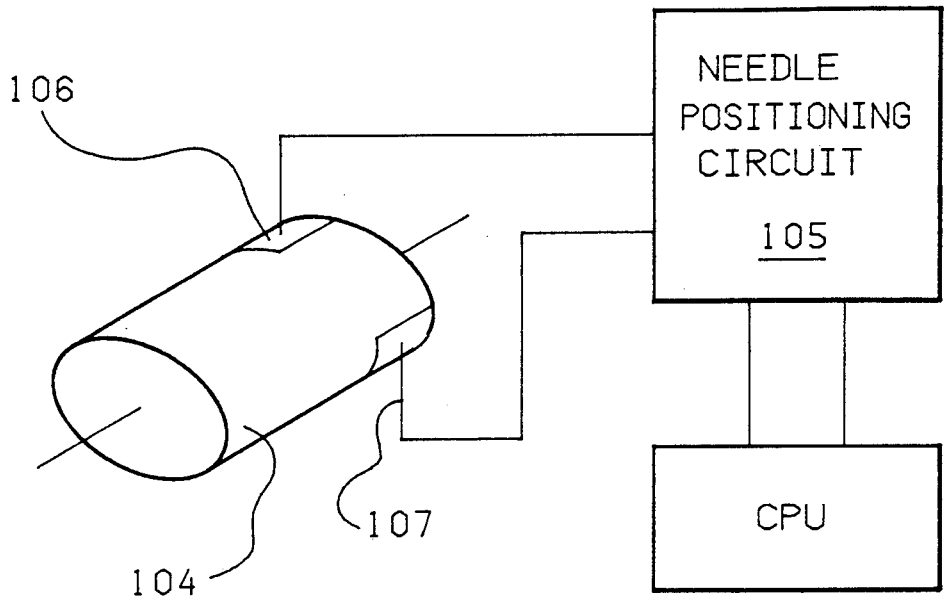
FIG. 2 shows a needle positioner control circuit.

The preferred embodiment is described as comprising a sewing machine 100 with a frame 101, a needle bar assembly 102 disposed within the frame to hold a needle 103, the machine having a needle positioner 104, sometimes called a synchronizer, a needle positioner circuit 105 having output lines 106 and 107 to set the needle in a first up position or in a second down position and foot operated treadle 108 with a circuit 109 which causes the machine to stitch when it is toed and to stop when the treadle is heeled, the circuit having means responsive to toeing whereby the stitch rate increases to a defined maximum proportional to increased toeing pressure and decreased to zero with heeling.

A stitch controller 10 is comprised of a box 11 which houses a central processing unit 20 and first connection means 12 which connect the CPU to the needle positioner circuit and second connection means 13 which connect the CPU to the treadle circuit. Optionally, third connection 13*a* means will connect the controller to a host CPU 200.

Adjacent to the box is a key pad 14 connected to the CPU for the purpose of entering data therein and a display 15 for displaying data stored in the CPU.

The CPU has a programmable memory 21 for storing a program cooperating with a first stitch counter/register 22, a second run counter/register 23 and a clock 24.

INSTALLATION

The stitch controller's first connection means 12 are installed at points in the needle positioner circuit which will set the needle in the first up position in response to a first set of signals from the CPU and in the second or down position in response to a second signal from the CPU. The first connection means are further attached at points in the needle positioner circuit which sense when the needle is in the first or second position.

Needle positioner circuits vary in design according to the manufacturer. An installer of ordinary skill in the art will readily find the points in the needle positioner circuit to make their installation of the first connection means appropriately.

The stitch controller's second connection means are installed at points in the treadle circuit which disable it such that conventional toeing pressure will send a first set of signals which activate the CPU to drive the machine and heeling will cause the machine to stop stitching. A second set of signals from the CPU when it is being driven will cause the stitch rate to increase to a defined maximum or decrease to zero without heeling by the operator. An installer of ordinary skill in the art will readily find the points in the treadle circuit to make the installation of the second connection means appropriately.

Figure 3:
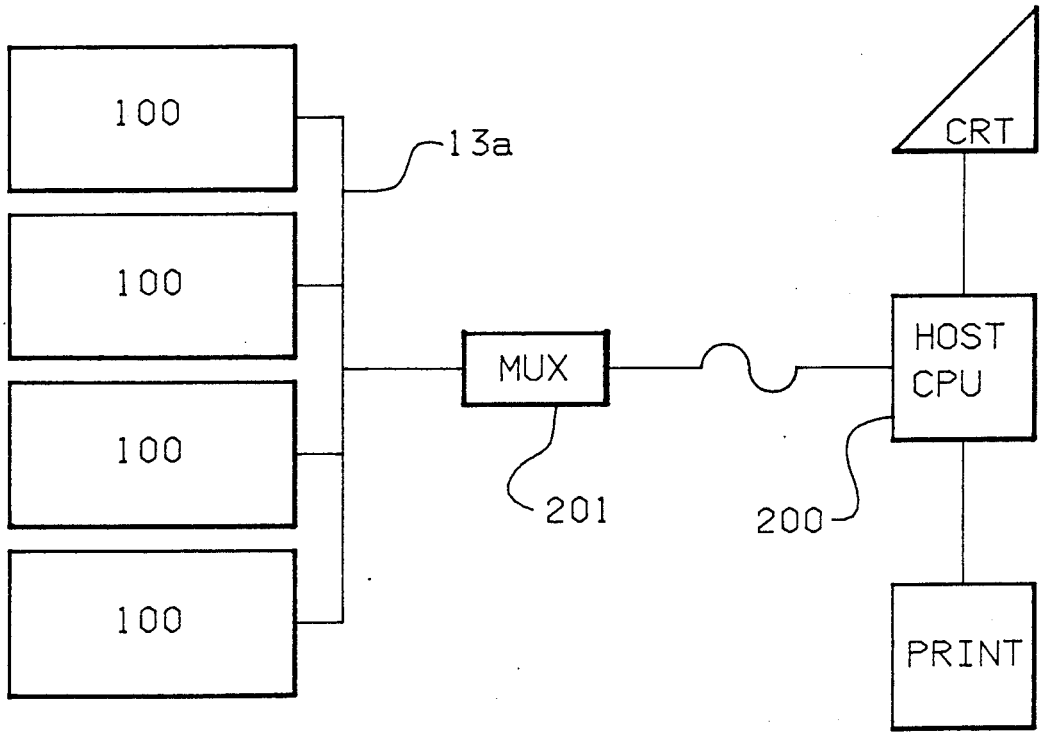
FIG. 3 shows a control system for a multiplicity of sewing machines.

In like manner, a multiplicity of machines (see FIG. 3) can be connected to the host CPU 200 through multiplexer circuit 201 by means well-known in the art.

OPERATION

A program is installed in the CPU's memory which is comprised of a multiplicity of sets of instructions. A first set of instructions from the CPU's memory will set the stitch counter register to equal a defined number of stitches, will decrement the counter by one for each stitch and set the needle in the second down position when the stitch counter is zero.

A second set of instructions from the CPU's memory will set the run counter register to equal a defined number of runs of stitches, decrement the counter by one for each run and set the needle in the first up position when the run counter is at zero.

A third set of instructions will calculate from the number of stitches set in the stitch register what the stitch rate shall be based on the number in the register such that the greater the number is in excess of a defined value the stitch rate will increase and approach the defined maximum stitch rate and when the register number is below the defined value, the stitch rate will decrease toward the zero as the register counter approaches zero and cause the stitching to stop at zero with the needle position up or down according to the first or second set of instructions.

PROGRAMMING THE CONTROLLER

The controller can be programmed by a multiplicity of methods. A first method is to enter by means of the key board a program label and data comprising a defined number of stitches as required to complete the first set of instructions and a defined number of runs of stitches as required by the second set of instructions. A second method is to retrieve the first and second set of instructions from the host CPU 200 by the third connection means.

A third method is for an operator actually to undertake a sewing procedure wherein a fourth set of instructions in the CPU memory will ask for and be given a label and count the number of stitches in a run and the number of runs of stitches, translate the counts into the first and second sets of instructions and store them. Thereafter, the label and the first and second set of instructions together as a program can be transmitted to the host.

Additionally, the controller can be programmed to contain within its memory a fifth set of instructions which will calculate and store in the controller's memory accounting and maintenance data such as machine running time, machine operating time, job and operator I.D., number of pieces sewn by the procedure and the like.

Since many modifications, variations and changes in detail may be made to the presently described embodiment, it is intended that all matters in the foregoing description and accompanying drawings be interpreted as illustrative and not by way of limitation.

What is claimed is:

1. A stitch controller for installation on an electric sewing machine which has a treadle with a circuit to vary the machine's stitching speed from zero to a defined maximum and a needle positioner with a circuit for halting the needle in a first up position and a second down position comprising:

(a) a box which contains the controller;

(b) a preprogrammable central processing unit within the box, the CPU having:

(i) a memory for storing a multiplicity of sets of instructions as a program with a label;

(ii) translation means for translating signals received by the CPU from the needle positioner circuit and the treadle circuit into data, (iii) means for compiling the data into the multiplicity of sets of instructions, (iv) means for transmitting each set of instructions to the needle positioner circuit;

(v) means for disabling the treadle circuit;

(vi) a clock;

(vii) a first resettable counter register for counting stitches made by the machine such that the counter decrements by a count of one for each stitch;

(viii) a second resettable counter register for counting runs of stitches such that the counter decrements by a count of one for each run;

(ix) means for halting the needle positioner in the second down position when the first counter is decremented to zero;

(x) means for halting the needle positioner in the first up position when the second counter is decremented to zero;

(xi) means for connecting the controller to the needle positioner circuit at a defined location;

(xii) means for connecting the controller to the treadle circuit at a defined location;

(xiii) means to calculate the machine's stitching speed;

(xiv) means to define the stitching speed;

(xv) means to disable the CPU's memory selectively;

(xvi) means to store in the CPU's memory a program comprising the first, second, third and fourth sets of instructions;

(c) a display mounted adjacent to the box, said display being connected to the CPU which displays information;

(d) a key pad mounted adjacent to the box, said key pad being connected to the CPU for entering data into the CPU's memory.

2. A sewing machine controller as in claim 1 wherein a first set of instructions from the CPU's memory sets the first counter to a defined number of stitches, decrements the counter by one count for each stitch completed by the machine and halts the needle in the second down position when the counter reaches zero.

3. A sewing machine controller as in claim 1 wherein a second set of instructions from the CPU's memory sets the second counter to a defined number of runs of stitches, decrements the counter by one count for each run of stitches completed by the machine and halts the needle in the first up position when the counter reaches zero.

4. A sewing machine controller as in claim 1 wherein a third set of instructions from the CPU's memory causes the stitch rate to increase to the defined maximum when the treadle is in the on position.

5. A sewing machine controller as in claim 1 wherein a fourth set of instructions from the CPU's memory causes the stitch rate to decrease at a defined rate to zero.

6. A sewing machine controller as in claim 1 including a connection means to connect the controller to a host CPU in which is stored a multiplicity of programs, each program comprising a label and a multiplicity of sets of instructions for transmission to the controller which define the number of stitches in a run, the number of runs of stitches, halting of the needle in the first or second position at the end of a run and the stitch rate, and means to transmit any of the programs when the controller identifies the label.

7. A sewing machine controller as in claim 1 wherein a fifth set of instructions will cause the controller's memory, when it is disabled, to receive signals from the needle positioner when the machine is operated manually by an operator, to translate the signals into new sets of the first and second set of instructions and to store said sets of instructions in the controller's memory.

8. A sewing machine controller as in claim 7 including means to transmit the new sets of instructions as a program to the host CPU.

9. A sewing machine controller as in claim 1 wherein the CPU has a third resettable register for counting a defined number of sewing machine procedures such that the counter decrements by a count of one for each sewing procedure, and displays a word on the display which indicates completion of the defined number of sewing procedures when the third counter is at zero.

* * * * *